US006145952A

United States Patent [19]

Sharma et al.

[11] Patent Number: 6,145,952

[45] Date of Patent: Nov. 14, 2000

[54] SELF-CLEANING INK JET PRINTER AND METHOD OF ASSEMBLING SAME

[75] Inventors: Ravi Sharma, Fairport; Michael Meichle, Rochester; Christopher N. Delametter, Rochester; John A. Quenin, Rochester, all of N.Y.

[73] Assignee: Eastman Kodak Company, Rochester, N.Y.

[21] Appl. No.: 09/174,794

[22] Filed: Oct. 19, 1998

[51] Int. Cl.[7] ..... B41J 2/165

[52] U.S. Cl. ..... 347/22; 347/28

[58] Field of Search ..... 347/22, 28

[56] References Cited

U.S. PATENT DOCUMENTS

| | | | |
|---|---|---|---|
| 3,373,437 | 3/1968 | Sweet et al. . | |
| 3,416,153 | 12/1968 | Hertz et al. . | |
| 3,705,043 | 12/1972 | Zabiak . | |
| 3,776,642 | 12/1973 | Anson et al. . | |
| 3,846,141 | 11/1974 | Ostergren et al. . | |
| 3,870,528 | 3/1975 | Edds et al. . | |
| 3,878,519 | 4/1975 | Easton . | |
| 3,889,269 | 6/1975 | Meyer et al. . | |
| 3,903,034 | 9/1975 | Zabiak et al. . | |
| 4,296,418 | 10/1981 | Yamazaki et al. | 347/28 |
| 4,346,387 | 8/1982 | Hertz | 347/75 |
| 4,591,870 | 5/1986 | Braun et al. | 347/25 |
| 4,734,718 | 3/1988 | Iwagami et al. | 347/28 |
| 4,908,636 | 3/1990 | Saito et al. . | |
| 4,970,535 | 11/1990 | Oswald et al. | 347/25 |
| 5,115,250 | 5/1992 | Harmon et al. | 347/33 |
| 5,148,746 | 9/1992 | Fuller et al. | 101/142 |
| 5,305,015 | 4/1994 | Schantz et al. | 347/47 |
| 5,350,616 | 9/1994 | Pan et al. | 428/131 |
| 5,412,411 | 5/1995 | Anderson | 347/28 |
| 5,426,458 | 6/1995 | Wenzel et al. | 347/45 |
| 5,431,722 | 7/1995 | Yamashita et al. | 106/31.43 |
| 5,725,647 | 3/1998 | Carlson et al. | 106/31.86 |
| 5,738,716 | 4/1998 | Santilli et al. | 106/31.77 |
| 5,774,140 | 6/1998 | English | 347/33 |
| 5,793,389 | 8/1998 | Mitchell | 347/28 |
| 5,997,127 | 12/1999 | Fassler et al. | 347/28 |

*Primary Examiner*—N. Le
*Assistant Examiner*—Shih-Wen Hsieh
*Attorney, Agent, or Firm*—Walter S. Stevens

[57] ABSTRACT

Self-cleaning printer and method of assembling same. The printer comprises a print head defining a plurality of ink channels therein, each ink channel terminating in an ink ejection orifice. The print head also has a surface thereon surrounding all the orifices. Particulate matter may reside on the surface and also may completely or partially obstruct the orifice. Therefore, a cleaning assembly is disposed relative to the surface and/or orifice for directing a flow of fluid along the surface and/or across the orifice to clean the particulate matter from the surface and/or orifice. The cleaning assembly includes a septum disposed opposite the surface or orifice for defining a gap therebetween. Presence of the septum accelerates the flow of fluid through the gap to induce a hydrodynamic shearing force in the fluid. This shearing force acts against the particulate matter to clean the particulate matter from the surface and/or orifice. A pump in fluid communication with the gap is also provided for pumping the fluid through the gap. As the surface and/or orifice is cleaned, the particulate matter is entrained in the fluid. A filter is provided to separate the particulate matter from the fluid.

32 Claims, 14 Drawing Sheets

SELF-CLEANING INK JET PRINTER AND METHOD OF ASSEMBLING SAME

BACKGROUND OF THE INVENTION

This invention generally relates to ink jet printer apparatus and methods and more particularly relates to a self-cleaning ink jet printer and method of assembling same.

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

In this regard, "continuous" ink jet printers utilize electrostatic charging tunnels that are placed close to the point where ink droplets are being ejected in the form of a stream. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium.

In the case of "on demand" ink jet printers, at every orifice an actuator is used to produce the ink jet droplet. In this regard, either one of two types of actuators may be used. These two types of actuators are heat actuators and piezoelectric actuators. With respect to heat actuators, a heater placed at a convenient location heats the ink and a quantity of the ink will phase change into a gaseous steam bubble and raise the internal ink pressure sufficiently for an ink droplet to be expelled to the recording medium. With respect to piezoelectric actuators, a piezoelectric material is used, which piezoelectric material possess piezoelectric properties such that an electric field is produced when a mechanical stress is applied. The converse also holds true; that is, an applied electric field will produce a mechanical stress in the material. Some naturally occurring materials possessing these characteristics are quartz and tourmaline. The most commonly produced piezoelectric ceramics are lead zirconate titanate, barium titanate, lead titanate, and lead metaniobate.

Inks for high speed ink jet printers, whether of the "continuous" or "piezoelectric" type, must have a number of special characteristics. For example, the ink should incorporate a nondrying characteristic, so that drying of ink in the ink ejection chamber is hindered or slowed to such a state that by occasional spitting of ink droplets, the cavities and corresponding orifices are kept open. The addition of glycol facilitates free flow of ink through the ink jet chamber. Of course, the ink jet print head is exposed to the environment where the ink jet printing occurs. Thus, the previously mentioned orifices are exposed to many kinds of air born particulates. Particulate debris may accumulate on surfaces formed around the orifices and may accumulate in the orifices and chambers themselves. That is, the ink may combine with such particulate debris to form an interference burr that blocks the orifice or that alters surface wetting to inhibit proper formation of the ink droplet. The particulate debris should be cleaned from the surface and orifice to restore proper droplet formation. In the prior art, this cleaning is commonly accomplished by brushing, wiping, spraying, vacuum suction, and/or spitting of ink through the orifice.

Thus, inks used in ink jet printers can be said to have the following problems: the inks tend to dry-out in and around the orifices resulting in clogging of the orifices; the wiping of the orifice plate causes wear on plate and wiper, the wiper itself producing particles that clog the orifice; cleaning cycles are time consuming and slow the productivity of ink jet printers. Moreover, printing rate declines in large format printing where frequent cleaning cycles interrupt the printing of an image. Printing rate also declines in the case when a special printing pattern is initiated to compensate for plugged or badly performing orifices.

Ink jet print head cleaners are known. An ink jet print head cleaner is disclosed in U.S. Pat. No. 4,970,535 titled "Ink Jet Print Head Face Cleaner" issued Nov. 13, 1990 in the name of James C. Oswald. This patent discloses an in jet print head face cleaner that provides a controlled air passageway through an enclosure formed against the print head face. Air is directed through an inlet into a cavity in the enclosure. The air that enters the cavity is directed past ink jet apertures on the head face and out an outlet. A vacuum source is attached to the outlet to create a subatmospheric pressure in the cavity. A collection chamber and removable drawer are positioned below the outlet to facilitate disposal of removed ink. Thus, the Oswald patent does not disclose use of brushes or wipers. However, the Oswald patent does not reference use of a liquid solvent to remove the ink; rather, the Oswald technique uses heated air to remove the ink. However, use of heated air is less effective for cleaning than use of a liquid solvent. Also, use of heated air may damage fragile electronic circuitry that may be present on the print head face. Moreover, the Oswald patent does not appear to clean the print head face in a manner that leaves printing speed unaffected by the cleaning operation.

Therefore, there is a need to provide a self-cleaning printer and method of assembling same, which self-cleaning printer allows cleaning without affecting printing speed.

SUMMARY OF THE INVENTION

An object of the present invention is to provide a self-cleaning printer and method of assembling same, which self-cleaning printer allows cleaning without affecting printing speed.

With this object in view, the present invention resides in a self-cleaning printer, comprising a print head having a surface thereon; and a structural member disposed opposite the surface for defining a gap therebetween sized to allow a flow of fluid through the gap, said member accelerating the flow of fluid to induce a shearing force in the flow of fluid, whereby the shearing force acts against the surface while the shearing force is induced in the flow of fluid and whereby the surface is cleaned while the shearing force acts against the surface.

According to an exemplary embodiment of the present invention, the self-cleaning printer comprises a print head defining a plurality of ink channels therein, each ink channel terminating in an orifice. The print head also has a surface thereon surrounding all the orifices. The print head is capable of ejecting ink droplets through the orifice, which ink droplets are intercepted by a receiver (e.g., paper or transparency) supported by a platen roller disposed adjacent the print head. Particulate matter may reside on the surface and may completely or partially obstruct the orifice. Such particulate matter may be particles of dirt, dust, metal and/or encrustations of dried ink. Presence of the particulate matter interferes with proper ejection of the ink droplets from their respective orifices and therefore may give rise to undesirable image artifacts, such as banding. It is therefore desirable to clean the particulate matter from the surface and/or orifice in a matter that does not affect printing speed.

Therefore, a cleaning assembly is disposed relative to the surface and/or orifice for directing a flow of fluid along the surface and/or across the orifice to clean the particulate matter from the surface and/or orifice. The cleaning assembly includes a septum disposed opposite the surface and/or orifice for defining a gap therebetween. The gap is sized to allow the flow of fluid through the gap. Presence of the septum accelerate, the flow of fluid in the gap to induce a hydrodynamic shearing force in the fluid. This shearing force acts against the particulate matter and cleans the particulate matter from the surface and/or orifice. A pump in fluid communication with the gap is also provided for pumping the fluid through the gap. In addition, a filter is provided to filter the particulate mater from the fluid for later disposal.

A feature of the present invention is the provision of a septum disposed opposite the surface and/or orifice for defining a gap therebetween capable of inducing a hydrodynamic shearing force in liquid flowing through the gap, which shearing force removes the particulate matter from the surface and/or orifice.

An advantage of the present invention is that the cleaning assembly belonging to the invention cleans the particulate matter from the surface and/or orifice without use of brushes or wipers which might otherwise damage the surface and/or orifice.

Another advantage of the present invention is that the surface and/or orifice is cleaned of the particulate matter without affecting printing speed.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTIONS OF THE DRAWINGS

While the specification concludes with claims particularly pointing-out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
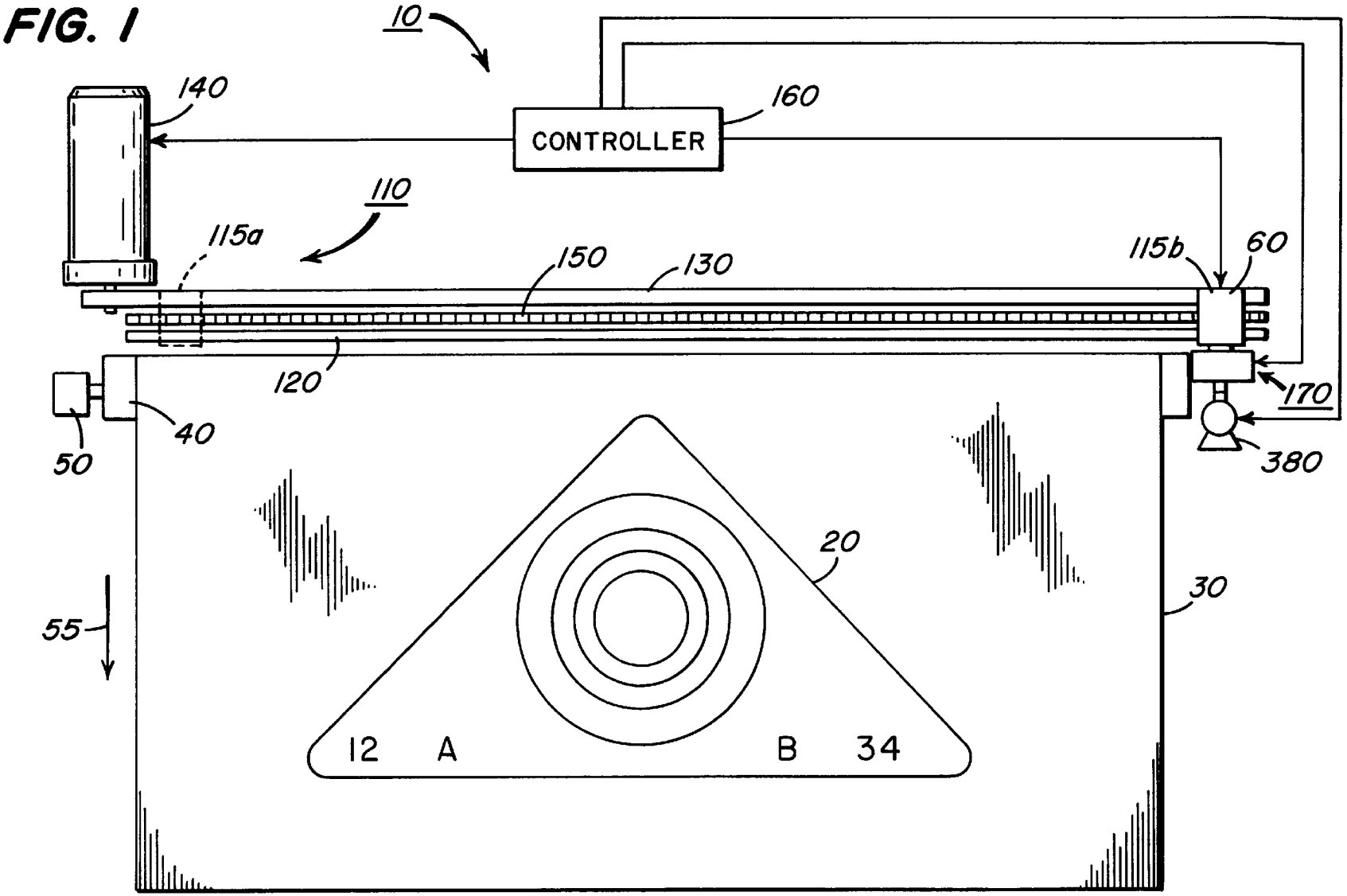
FIG. 1 is a view in elevation of a self-cleaning ink jet printer belonging to the present invention, the printer including a print head.

Therefore, referring to FIG. 1, there is shown a self-cleaning printer, generally referred to as 10, for printing an image 20 on a receiver 30, which may be a reflective-type receiver (e.g., paper) or a transmissive-type receiver (e.g., transparency). Receiver 30 is supported on a platen roller 40 which is capable of being rotated by a platen roller motor 50 engaging platen roller 40. Thus, when platen roller motor 50 rotates platen roller 40, receiver 30 will advance in a direction illustrated by first arrow 55.

Figure 2:
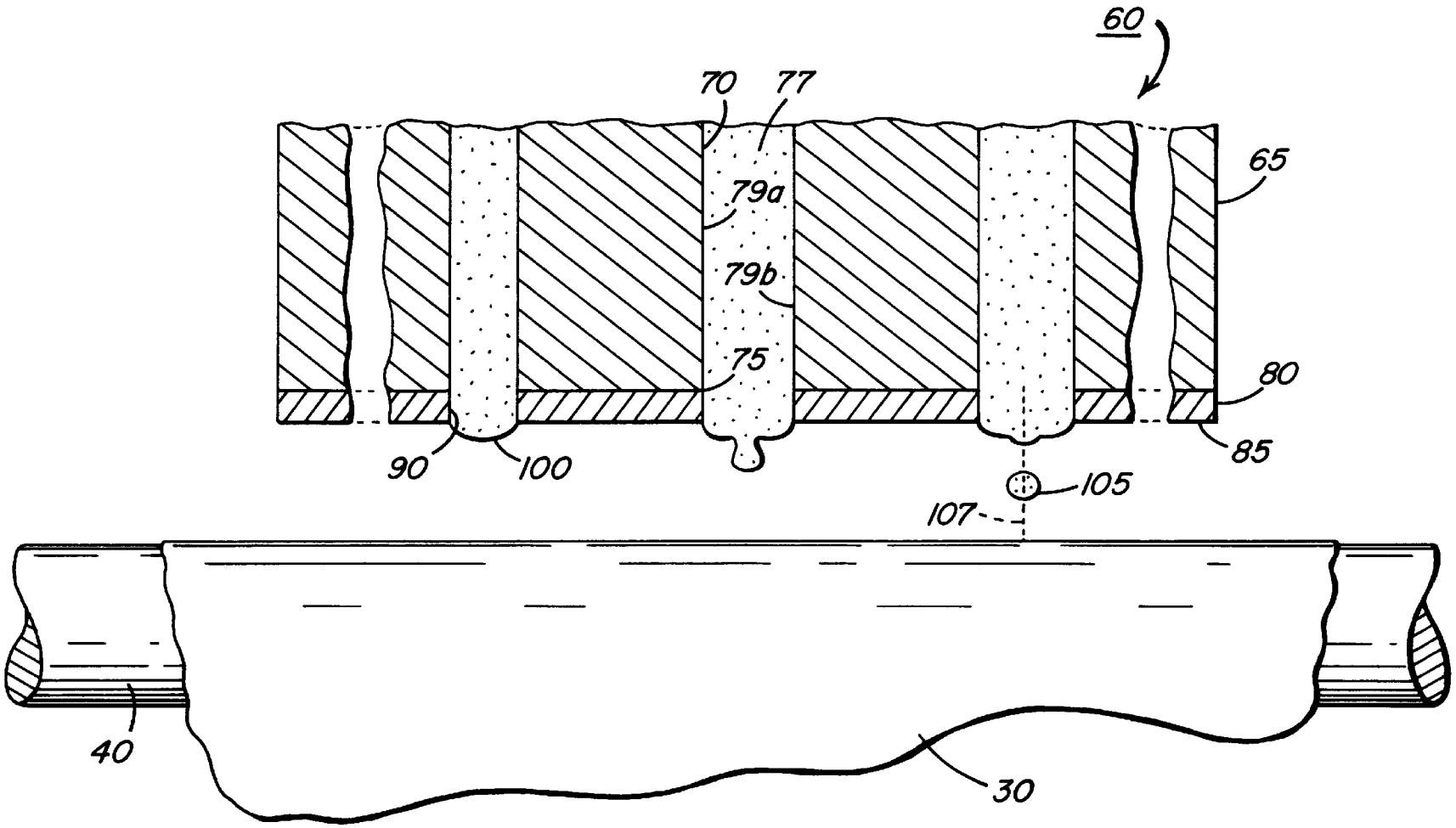
FIG. 2 is a fragmentation view in vertical section of the print head, the print head defining a plurality of channels therein, each channel terminating in an orifice.

Referring to FIGS. 1 and 2, printer 10 also comprises a print head 60 disposed adjacent to platen roller 40. Print head 60 comprises a print head body 65 having a plurality of ink channels 70, each channel 70 terminating in a channel outlet 75. In addition, each channel 70, which is adapted to hold an ink body 77 therein, is defined by a pair of oppositely disposed parallel side walls 79*a* and 79*b*. Attached, such as by a suitable adhesive, to print head body 65 is a cover plate 80 having a plurality of orifices 90 formed therethrough colinearly aligned with respective ones of channel outlets 75, such that each orifice 90 faces receiver 30. A surface 85 of cover plate 80 surrounds all orifices 90 and also faces receiver 20. When ink body 77 fills channel 70, a convex-shaped meniscus 100 forms at orifice 90 and is held at orifice 90 by surface tension of meniscus 100. Of course, in order to print image 20 on receiver 30, an ink droplet 105 must be released from orifice 90 in direction of receiver 20, so that droplet 105 is intercepted by receiver 20. To achieve this result, print head body 65 may be a "piezoelectric ink jet" print head body formed of a piezoelectric material, such as lead zirconium titanate (PZT). Such a piezoelectric material is mechanically responsive to electrical stimuli so that side walls 79*a*/*b* simultaneously inwardly deform when electrically stimulated. When side walls 79*a*/*b* simultaneously inwardly deform, volume of channel 70 decreases to squeeze ink droplet 105 from channel 70.

Referring again to FIGS. 1 and 2, a transport mechanism, generally referred to as 10, is connected to print head 60 for reciprocating print head 60 between a first position 115*a* thereof (shown in phantom) and a second position 115*b*. Print head 60 slidably engages an elongate guide rail 120, which guides print head 60 parallel to platen roller 40 while print head 60 is reciprocated. Transport mechanism 110 also comprises a drive belt 130 attached to print head 60 for reciprocating print head 60 between first position 115*a* and second position 115*b*, as described presently. In this regard, a reversible drive belt motor 140 engages belt 130, such that belt 130 reciprocates in order that print head 60 reciprocates with respect to platen 40. Moreover, an encoder strip 150 coupled to print head 60 monitors position of print head 60 as print head 60 reciprocates between first position 115*a* and second position 115*b*. In addition, a controller 160 is connected to platen roller motor 50, drive belt motor 140, encoder strip 150 and print head 60 for controlling operation thereof to suitably form image 20 on receiver 30. Such a controller may be a Model CompuMotor controller available from Parker Hannifin located in Rohnert Park, Calif.

Figure 3:
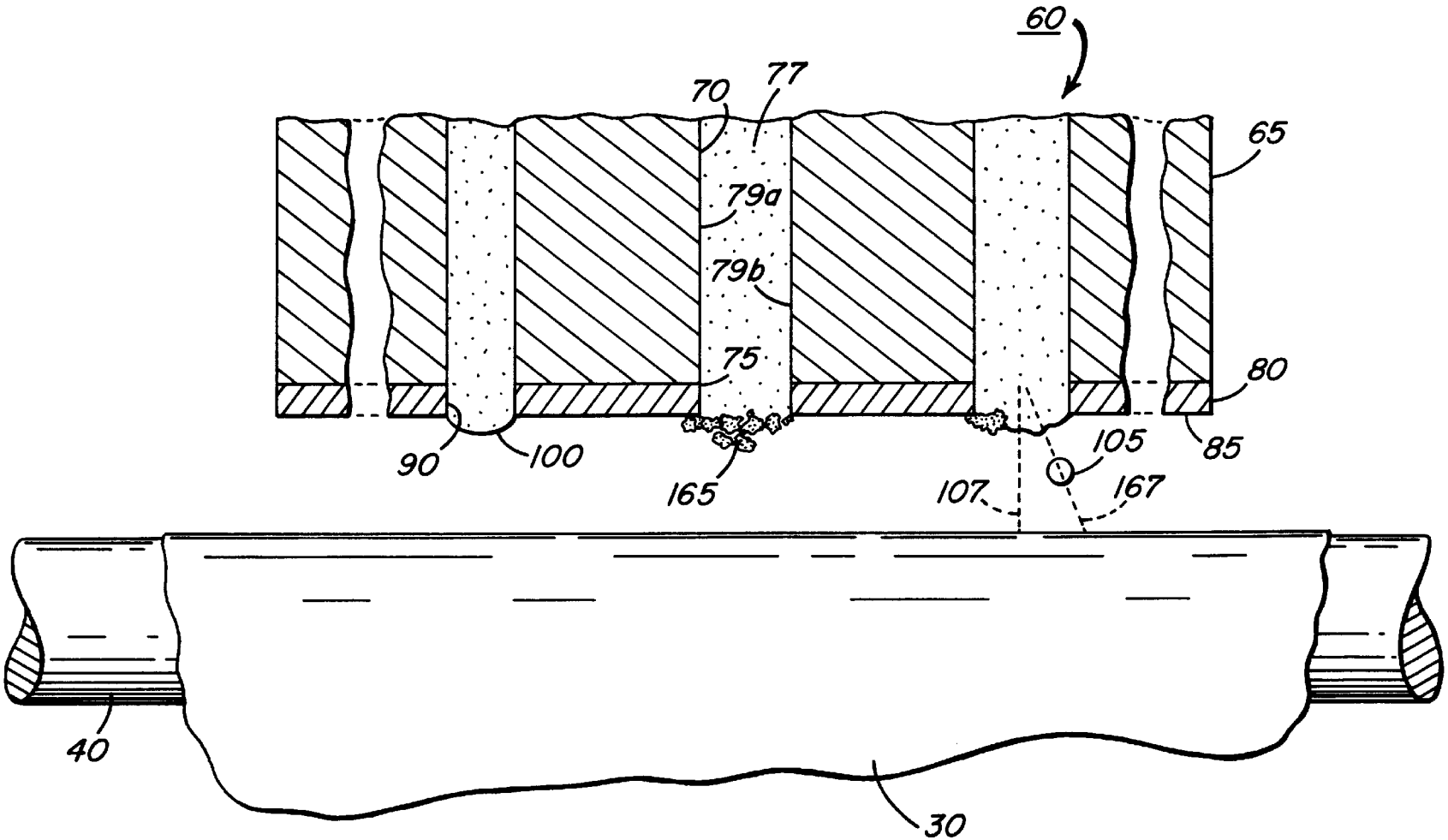
FIG. 3 is a fragmentation view in vertical section of the print head, this view showing some of the orifices encrusted with particulate matter to be removed.
Figure 4:
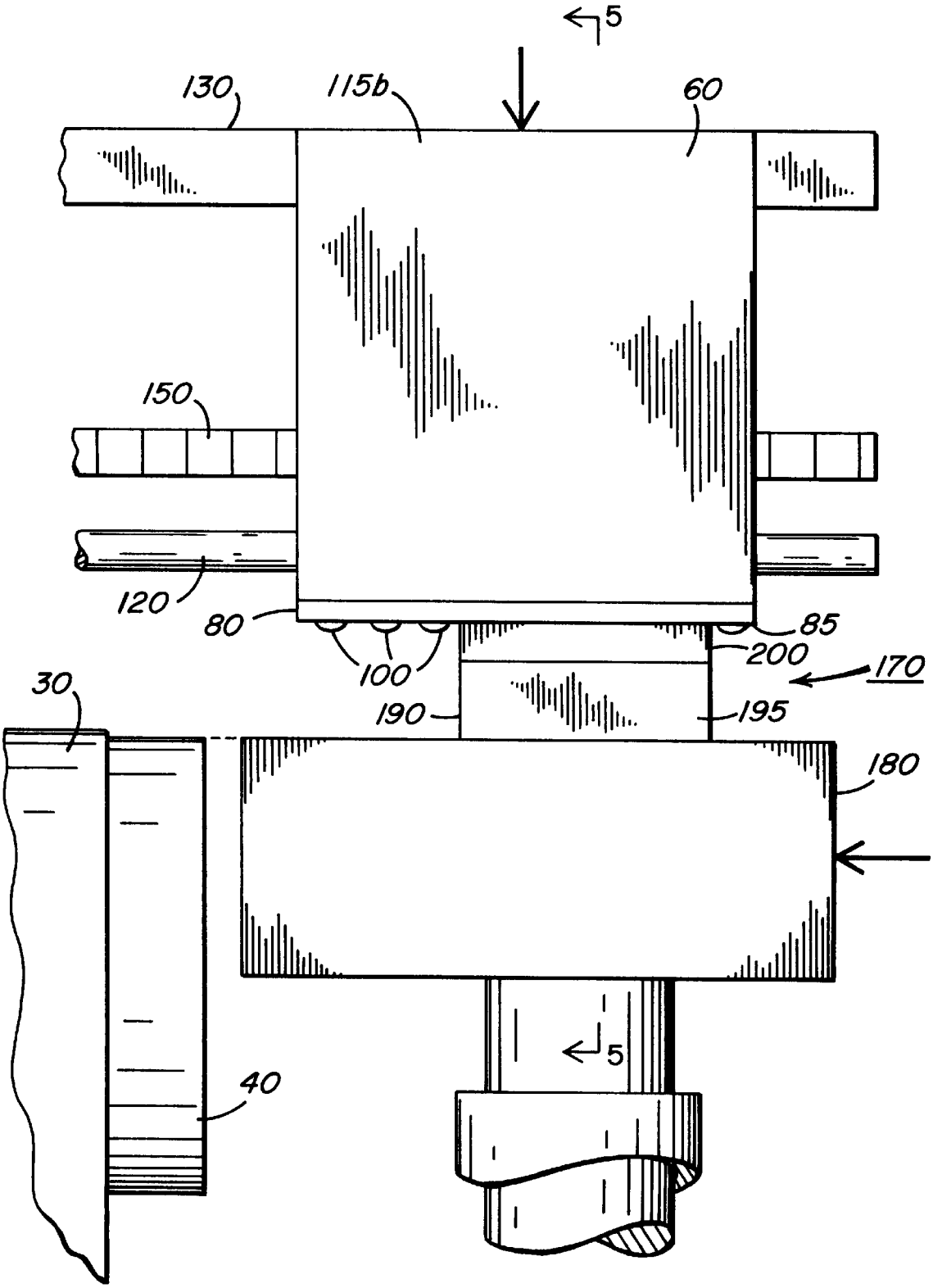
FIG. 4 is a view in elevation of a cleaning assembly for removing the particulate matter.

Turning now to FIG. 3, it has been observed that cover plate 80 may become contaminated by particulate matter 165 which will reside on surface 85. Such particulate matter 165 also may partially or completely obstruct orifice 90. Particulate matter 165 may be, for example, particles of dirt, dust, metal and/or encrustations of dried ink. Presence of particulate matter 165 is undesirable because when particulate matter 165 completely obstructs orifice 90, ink droplet 105 is prevented from being ejected from orifice 90. Also, when particulate matter 165 partially obstructs orifice 90, flight of ink droplet 105 may be diverted from first axis 107 to travel along a second axis 167 (as shown). If ink droplet 105 travels along second axis 167, ink droplet 105 will land on receiver 30 in an unintended location. In this manner, such complete or partial obstruction of orifice 90 leads to printing artifacts such as "banding", a highly undesirable result. Also, presence of particulate matter 165 may alter surface wetting and inhibit proper formation of droplet 105. Therefore, it is desirable to clean (i.e., remove) particulate matter 165 to avoid printing artifacts. Moreover, removal of particulate matter 165 should be performed in a manner such that printing speed is unaffected.

Therefore, referring to FIGS. 1, 4, 5 and 6, a cleaning assembly, generally referred to as 170, is disposed proximate surface 85 for directing a flow of cleaning liquid along surface 85 and across orifice 90 to clean particulate matter 165 therefrom while print head 60 is disposed at second position 115*b*. Cleaning assembly 170 may comprise a housing 180 for reasons described presently. Attached to housing 180 is a generally rectangular cup 190 having an open end 195 and defining a cavity 197 communicating with open end 195. Attached, such as by a suitable adhesive, to open end 195 is an elastomeric seal 200, which may be rubber or the like, encircling one or more orifices 90 and sealingly engaging surface 85. Extending along cavity 197 and oriented perpendicularly opposite orifices 90 is a structural member, such as an elongate septum 210. Septum 210 has an end portion 215 which, when disposed opposite orifice 90, defines a gap 220 of predetermined size between orifice 90 and end portion 215. Moreover, end portion 215 of septum 210 may be disposed opposite a portion of surface 85, not including orifice 90, so that gap 220 is defined between surface 85 and end portion 215. As described in more detail hereinbelow, gap 220 is sized to allow flow of a liquid therethrough in order to clean particulate matter 165 from surface 85 and/or orifice 90. By way of example only, and not by way of limitation, the velocity of the liquid through gap 220 may be about 1 to 20 meters per second. Also by way of example only, and not by way of limitation, height of gap 220 may be approximately 3 to 30 thousandths of an inch with a preferred gap height of approximately 5 to 20 thousandths of an inch. Moreover, hydrodynamic pressure applied to the liquid in the gap due, at least in part, to presence of septum 210 may be approximately 1 to 30 psi (pounds per square inch). Septum 210, partitions (i.e., divides) cavity 197 into an inlet chamber 230 and an outlet chamber 240, for reasons described more fully hereinbelow.

Referring again to FIGS. 1, 4, 5 and 6, interconnecting inlet chamber 230 and outlet chamber 240 is a closed-loop piping circuit 250. It will be appreciated that piping circuit 250 is in fluid communication with gap 220 for recycling the liquid through gap 220. In this regard, piping circuit 250 comprises a first piping segment 260 extending from outlet chamber 240 to a reservoir 270 containing a supply of the liquid. Piping circuit 250 further comprises a second piping segment 280 extending from reservoir 270 to inlet chamber 230. Disposed in second piping segment 280 is a recirculation pump 290 for pumping the liquid from reservoir 270, through second piping segment 280, into inlet chamber 230, through gap 220, into outlet chamber 240, through first piping segment 260 and back to reservoir 270, as illustrated by a plurality of second arrows 295. Disposed in first piping segment 260 may be a first filter 300 and disposed in second piping segment 280 may be a second filter 310 for filtering (i.e., separating) particulate matter 165 from the liquid as the liquid circulates through piping circuit 250.

Figure 5:
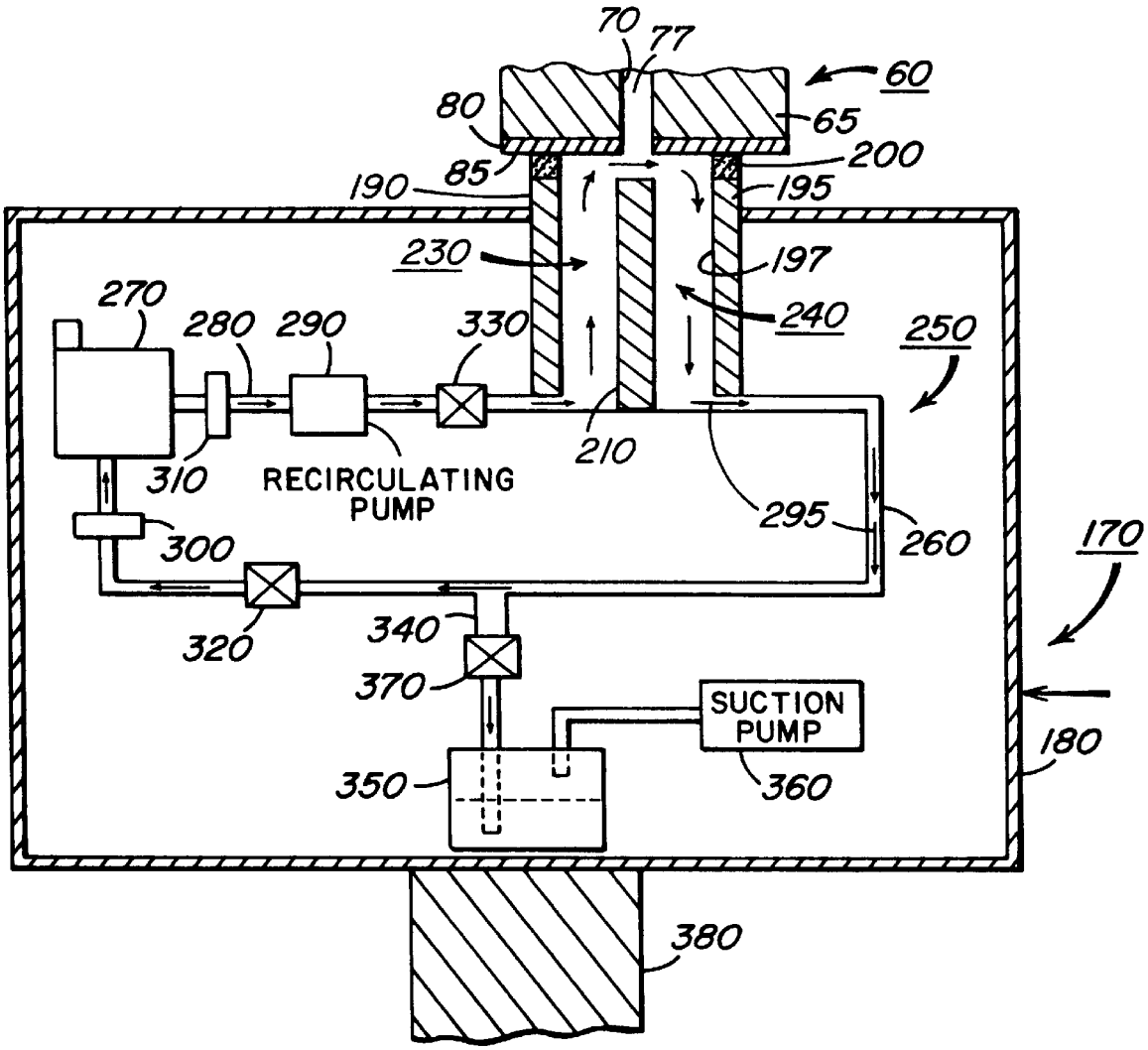
FIG. 5 is a view in vertical section of the cleaning assembly, the cleaning assembly including a septum disposed opposite the orifice so as to define a gap between the orifice and the septum.

As best seen in FIG. 5, a first valve 320 is preferably disposed at a predetermined location in first piping segment 260, which first valve 320 is operable to block flow of the liquid through first piping segment 260. Also, a second valve 330 is preferably disposed at a predetermined location in second piping segment 280, which second valve 330 is operable to block flow of the liquid through second piping segment 280. In this regard, first valve 320 and second valve 330 are located in first piping segment 260 and second piping segment 280, respectively, so as to isolate cavity 197 from reservoir 270, for reasons described momentarily. A third piping segment 340 has an open end thereof connected to first piping segment 260 and another open end thereof received into a sump 350. In communication with sump 350 is a suction (i.e., vacuum) pump 360 for reasons described presently. Moreover, disposed in third piping segment 340 is a third valve 370 operable to isolate piping circuit 250 from sump 350.

Figure 6:
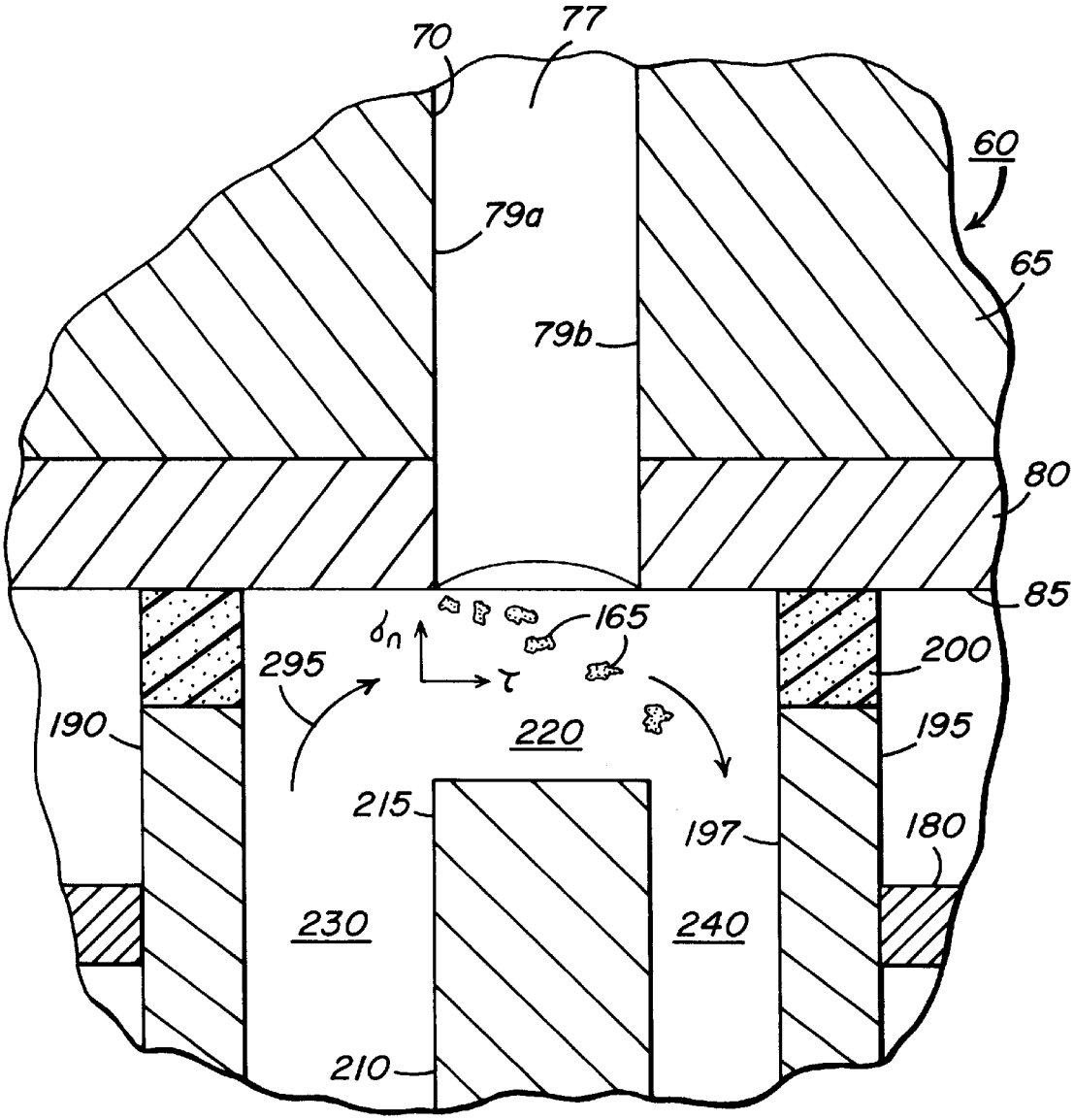
FIG. 6 is an enlarged fragmentation view in vertical section of the cleaning assembly, this view also showing the particulate matter being removed from the surface and orifice by a liquid flowing through the gap.

Referring to FIGS. 5 and 6, during operation of cleaning assembly 170, first valve 320 and second valve 310 are opened while third valve 370 is closed. Recirculation pump 290 is then operated to draw the liquid from reservoir 270 and into inlet chamber 230. The liquid will then flow through gap 220. However, as the liquid flows through gap 220 a hydrodynamic shearing force will be induced in the liquid due to presence of end portion 215 of septum 210. It is believed this shearing force is in turn caused by a hydrodynamic stress forming in the liquid, which stress has a "normal" component $\delta_n$ acting normal to surface 85 (or orifice 90) and a "shear" component $\tau$ acting along surface 85 (or across orifice 90). Vectors representing the normal stress component $\delta_n$ and the shear stress component $\tau$ are best seen in FIG. 6. The previously mentioned hydrodynamic shearing force acts on particulate matter 165 to remove particulate matter 165 from surface 85 and/or orifice 90, so that particulate matter 165 becomes entrained in the liquid flowing through gap 220. As particulate matter 165 is cleaned from surface 85 and orifice 90 the liquid with particulate matter 165 entrained therein, flows into outlet chamber 240 and from there into first piping segment 260. As recirculation pump 290 continues to operate, the liquid with entrained particulate matter 165 flows to reservoir 270 from where the liquid is pumped into second piping segment 280. However, it is preferable to remove particulate matter 165 from the liquid as the liquid is recirculated through piping circuit 250 in order that particulate matter 165 is not redeposited onto surface 85 and across orifice 90. Thus, first filter 300 and second filter 310 are provided for filtering particulate matter 165 from the liquid recirculating through piping circuit 250. After a desired amount of particulate matter 165 is cleaned from surface 85 and/or orifice 90, recirculation pump 290 is caused to cease operation and first valve 320 and second valve 330 are closed to isolate cavity 197 from reservoir 270. At this point, third valve 370 is opened and suction pump 360 is operated to substantially suction the liquid from first piping segment 260, second piping segment 280 and cavity 197. This suctioned liquid flows into sump 350 for later disposal. However, the liquid flowing into sump 350 is substantially free of particulate matter 165 due to presence of filters 300/310 and thus may be recycled into reservoir 270, if desired.

Figure 7:
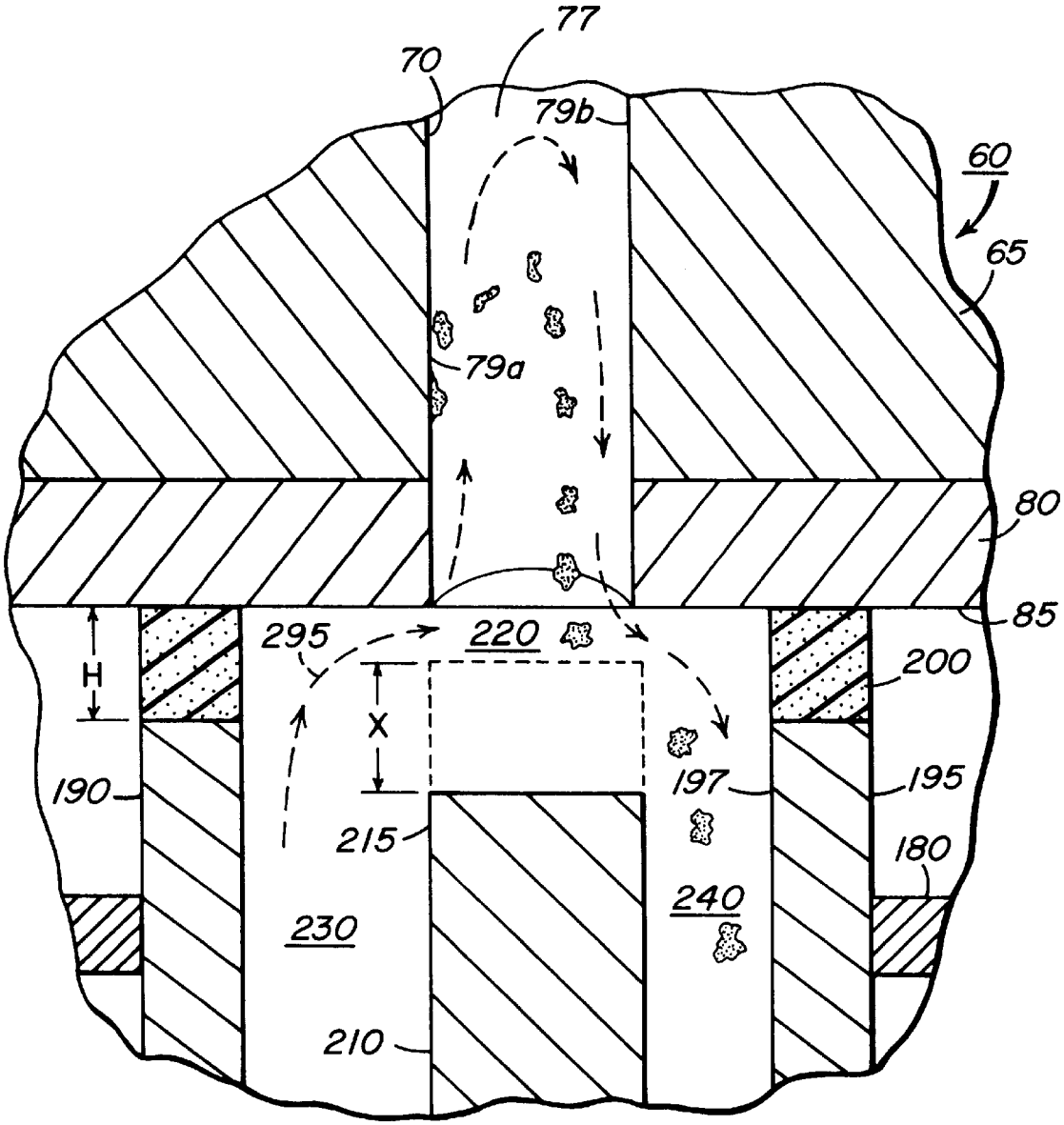
FIG. 7 is an enlarged fragmentation view in vertical section of the cleaning assembly, this view showing the gap having reduced height due to increased length of the septum, for cleaning particulate matter from within the ink channel.
Figure 8:
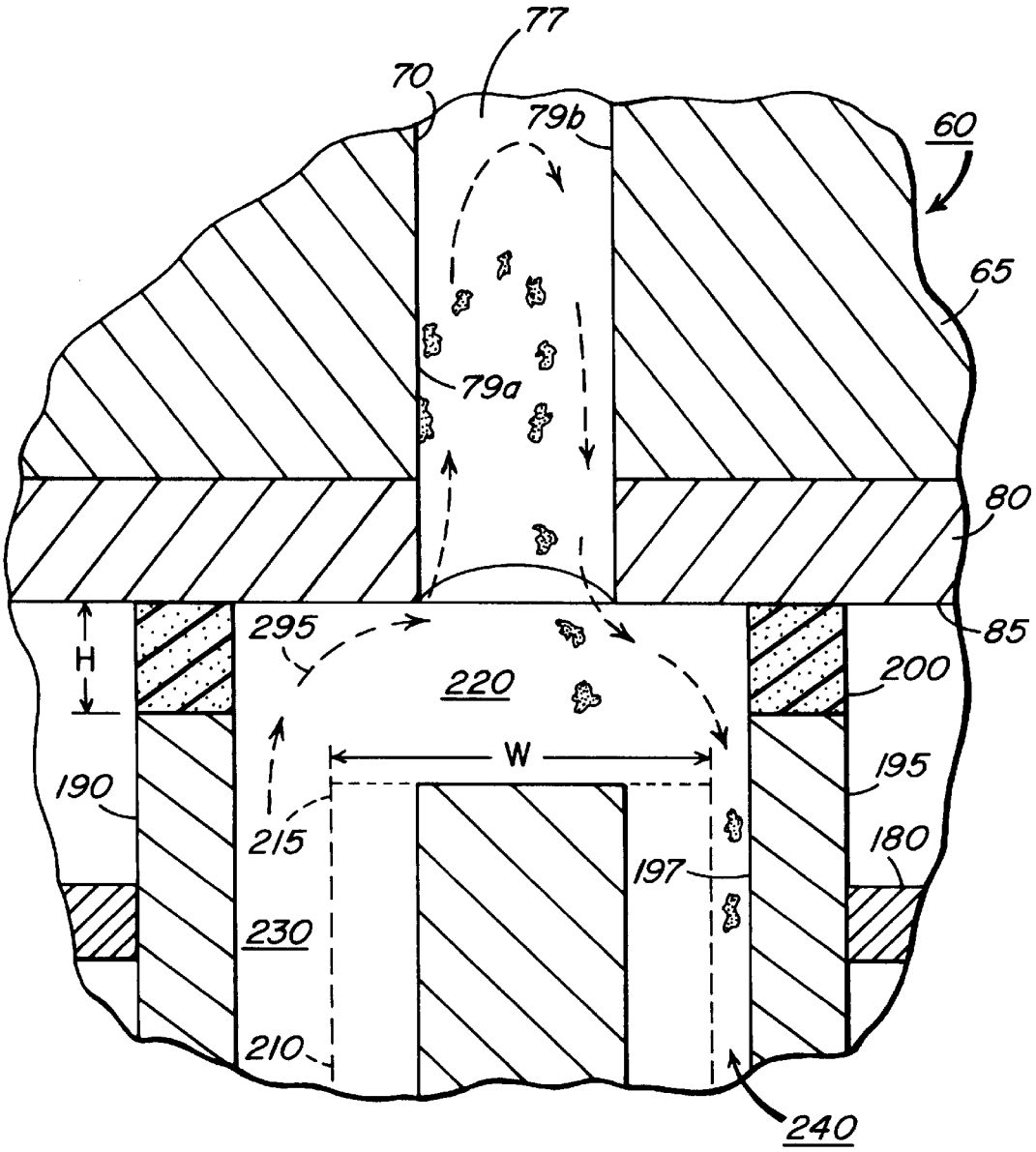
FIG. 8 is an enlarged fragmentation view in vertical section of the cleaning assembly, this view showing the gap having increased width due to increased width of the septum, also for cleaning particulate matter from within the ink channel.

Referring to FIGS. 7 and 8, it has been discovered that length and width of elongate septum 210 controls amount of hydrodynamic stress force acting against surface 85 and orifice 90. This effect is important in order to control severity of cleaning action. Also, it has been discovered that, when end portion 215 of septum 210 is disposed opposite orifice 90, length and width of elongate septum 210 controls amount of penetration (as shown) of the liquid into channel 70. It is believed that control of penetration of the liquid into channel 70 is in turn a function of the amount of normal stress $\delta_n$. However, it has been discovered that the amount of normal stress $\delta_n$ is inversely proportional to height of gap 220. Therefore, normal stress $\delta_n$, and thus amount of penetration of the liquid into channel 70, can be increased by decreasing height of gap 220. Moreover, it has been discovered that amount of normal stress $\delta_n$ is directly proportional to pressure drop in the liquid as the liquid slides along end portion 215 and surface 85. Therefore, normal stress $\delta_n$, and thus amount of penetration of the liquid into channel 70, also can be increased by increasing width (i.e., run) of gap 220. These effects are important in order to clean any particulate matter 165 which may be adhering to either of side walls 79*a* or 79*b*. More specifically, when elongate septum 210 is fabricated so that it has a greater length X, height of gap 220 is decreased to enhance the cleaning action, if desired. Also, when elongate septum 210 is fabricated so that it has a greater width W, the run of gap 220 is increased to enhance the cleaning action, if desired. Thus, a person of ordinary skill in the art may, without undue experimentation, vary both the length X and width W of septum 210 to obtain an optimum gap size for obtaining optimum cleaning depending on the amount and severity of particulate matter encrustation. It may be appreciated from the discussion hereinabove, that a height H of seal 200 also may be varied to vary size of gap 220 with similar results.

Returning to FIG. 1, an elevator 380 may be connected to cleaning assembly 170 for elevating cleaning assembly 170 so that seal 200 sealingly engages surface 85 when print head 60 is at second position 115*b*. To accomplish this result, elevator 380 is connected to controller 160, so that operation of elevator 380 is controlled by controller 160. Of course, when the cleaning operation is completed, elevator 380 may be lowered so that seal 200 no longer engages surface 85.

However, as previously stated, cleaning of particulate matter 165 should be accomplished so that printing speed is unaffected. In this regard, controller 160, which controls movement of print head 60 via motor 140 and belt 130, causes print head 60 to decelerate as print head 60 leaves the edge of receiver 30 and travels toward second position 115*b* to be cleaned by cleaning assembly 170. After surface 85 and/or orifice 90 is cleaned, as previously described, print head 60 is caused to accelerate as print head 60 leaves cleaning assembly 170 and travels back toward receiver 30. Rate of acceleration of print head 60 is chosen to compensate both for the rate of deceleration of print head 60 and the amount of time print head 60 dwells at second position 115*b*. It is this acceleration of print head 60 back toward receiver 30 that is advantageously used to clean surface 85 and/or orifice 90 without increasing printing time. Alternatively, cleaning of print head 60 may be accomplished between printing of separate pages, rather than during printing of a page. Of course, print head 60 travels at a constant speed when it reaches receiver 30 to print image 20.

Figure 9:
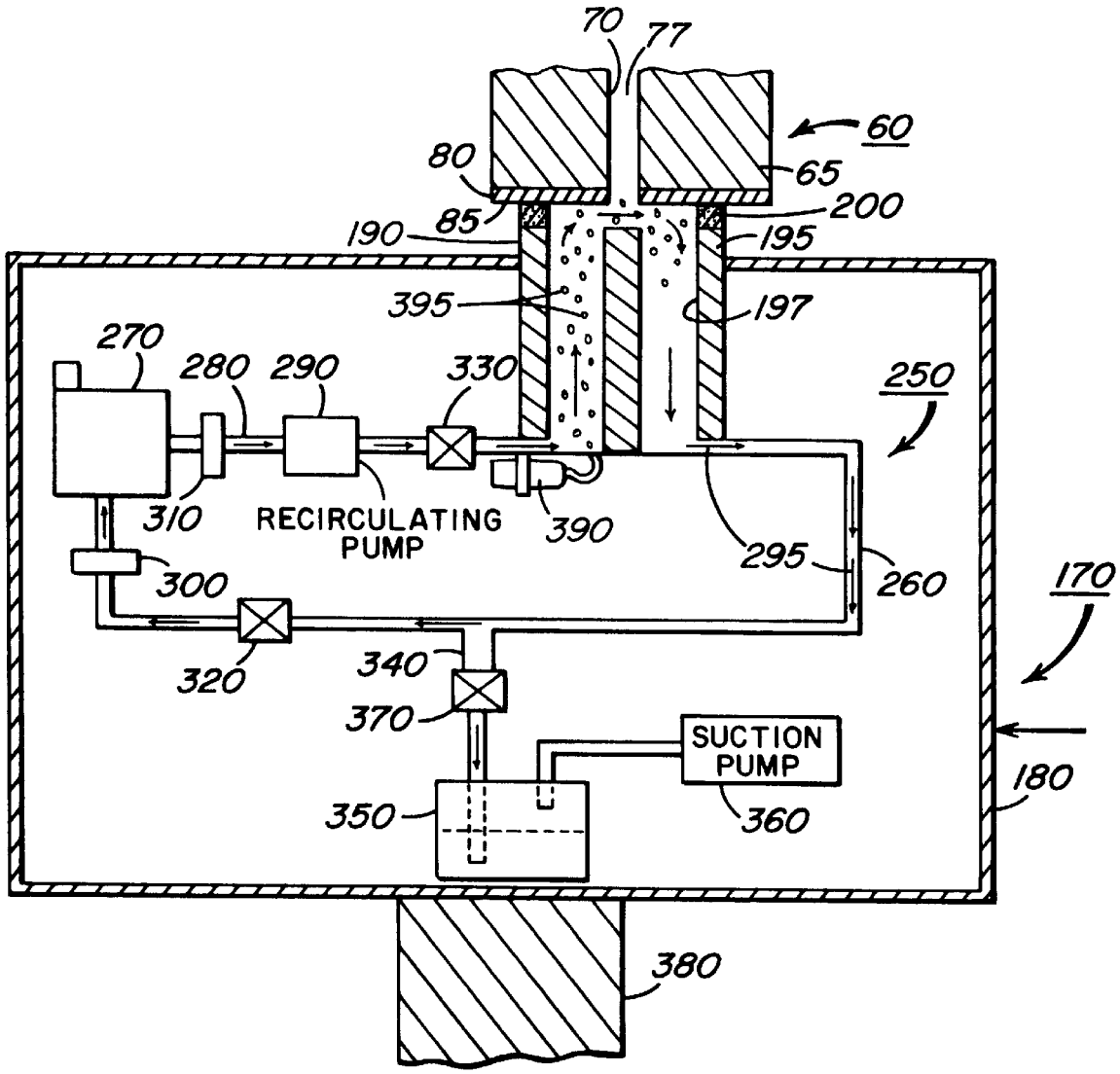
FIG. 9 is a view in vertical section of a second embodiment of the invention, wherein the cleaning assembly includes a pressurized gas supply in fluid communication with the gap for introducing gas bubbles into the liquid in the gap.
Figure 10:
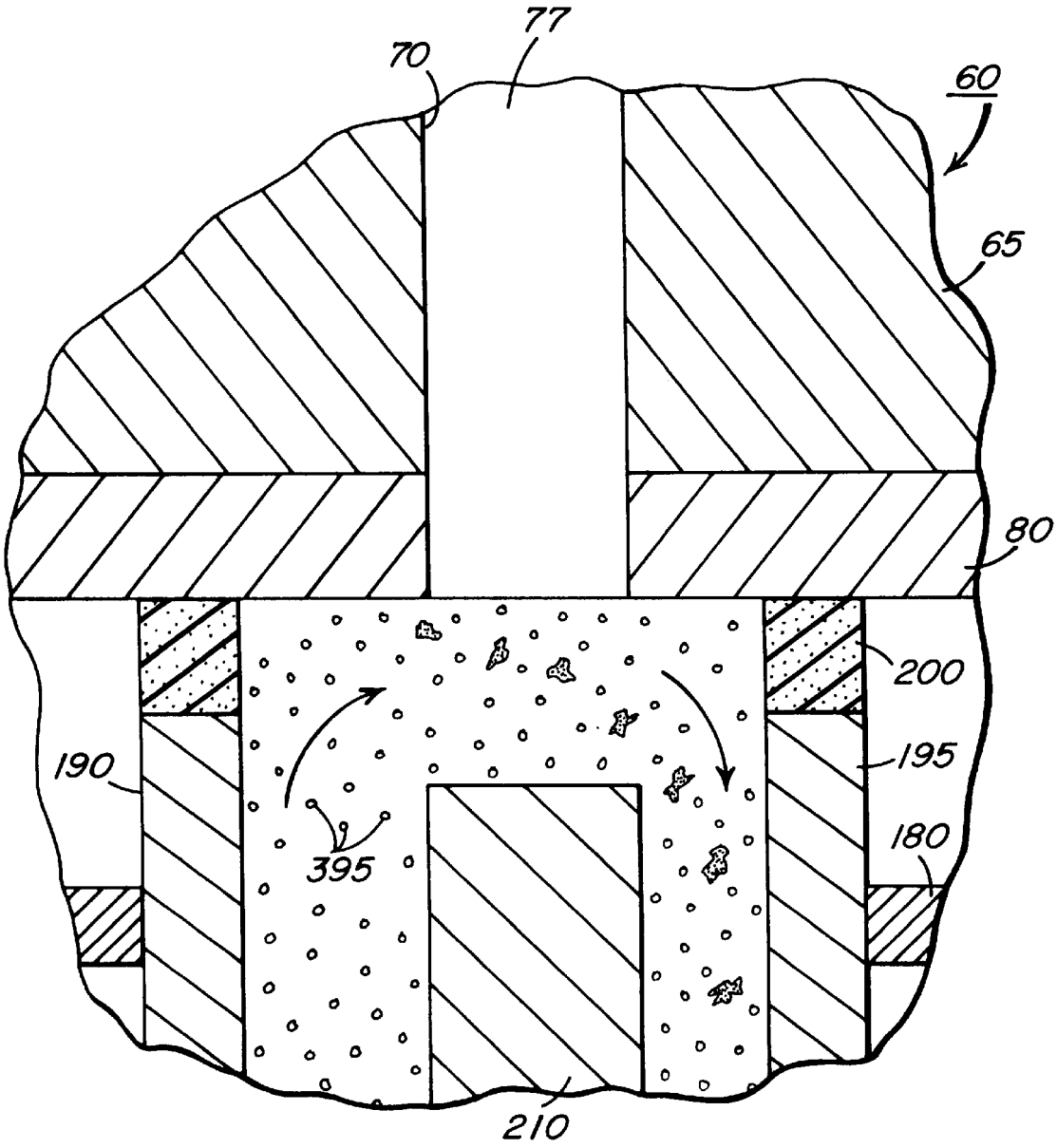
FIG. 10 is an enlarged fragmentation view in vertical section of the cleaning assembly of the second embodiment, showing the gas bubbles being introduced into the liquid in the gap.

Referring to FIGS. 9 and 10, there is shown a second embodiment of the present invention. In this second embodiment of the invention, a pressurized gas supply 390 is in communication with gap 220 for injecting a pressurized gas into gap 220. The gas will form a multiplicity of gas bubbles 395 in the liquid to enhance cleaning of particulate matter 165 from surface 85 and/or orifice 90. Gas bubbles 395 achieve this result by exerting pressure on particulate matter 165.

Figure 11:
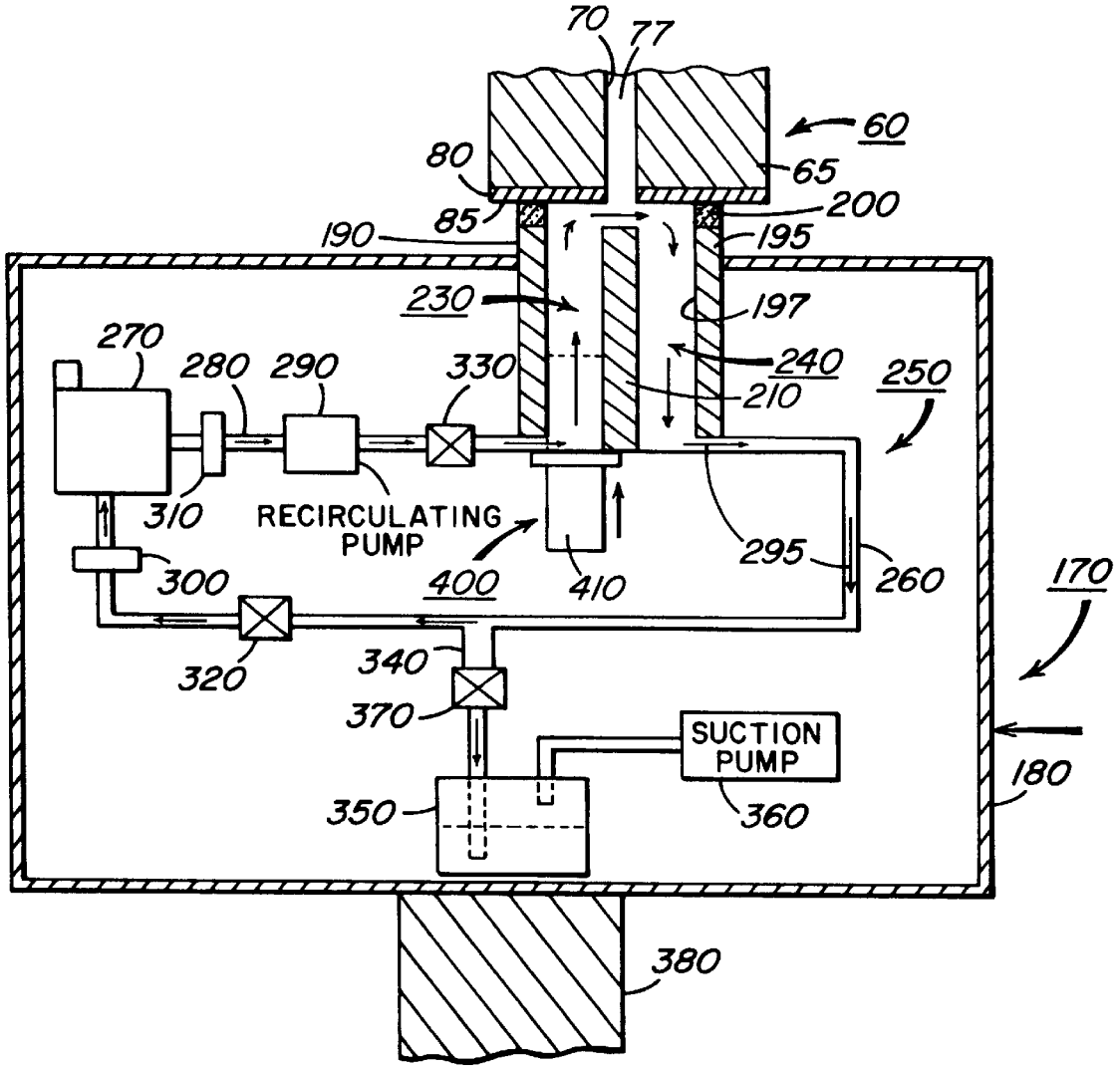
FIG. 11 is a view in vertical section of a third embodiment of the invention, wherein the cleaning assembly includes a pressure pulse generator in communication with the gap for generating a plurality of pressure pulses in the liquid in the gap.

Referring to FIG. 11, there is shown a third embodiment of the present invention. In this third embodiment of the invention, a pressure pulse generator, such as a piston arrangement, generally referred to as 400, is in fluid communication with inlet chamber 230. Piston arrangement 400 comprises a reciprocating piston 410 for generating a plurality of pressure pulse waves in inlet chamber 230, which pressure waves propagate in the liquid in inlet chamber 230 and enter gap 220. Piston 410 reciprocates between a first position and a second position, the second position being shown in phantom. The effect of the pressure waves is to enhance cleaning of particulate matter 165 from surface 85 and/or orifice 90 by force of the pressure waves.

Figure 12:
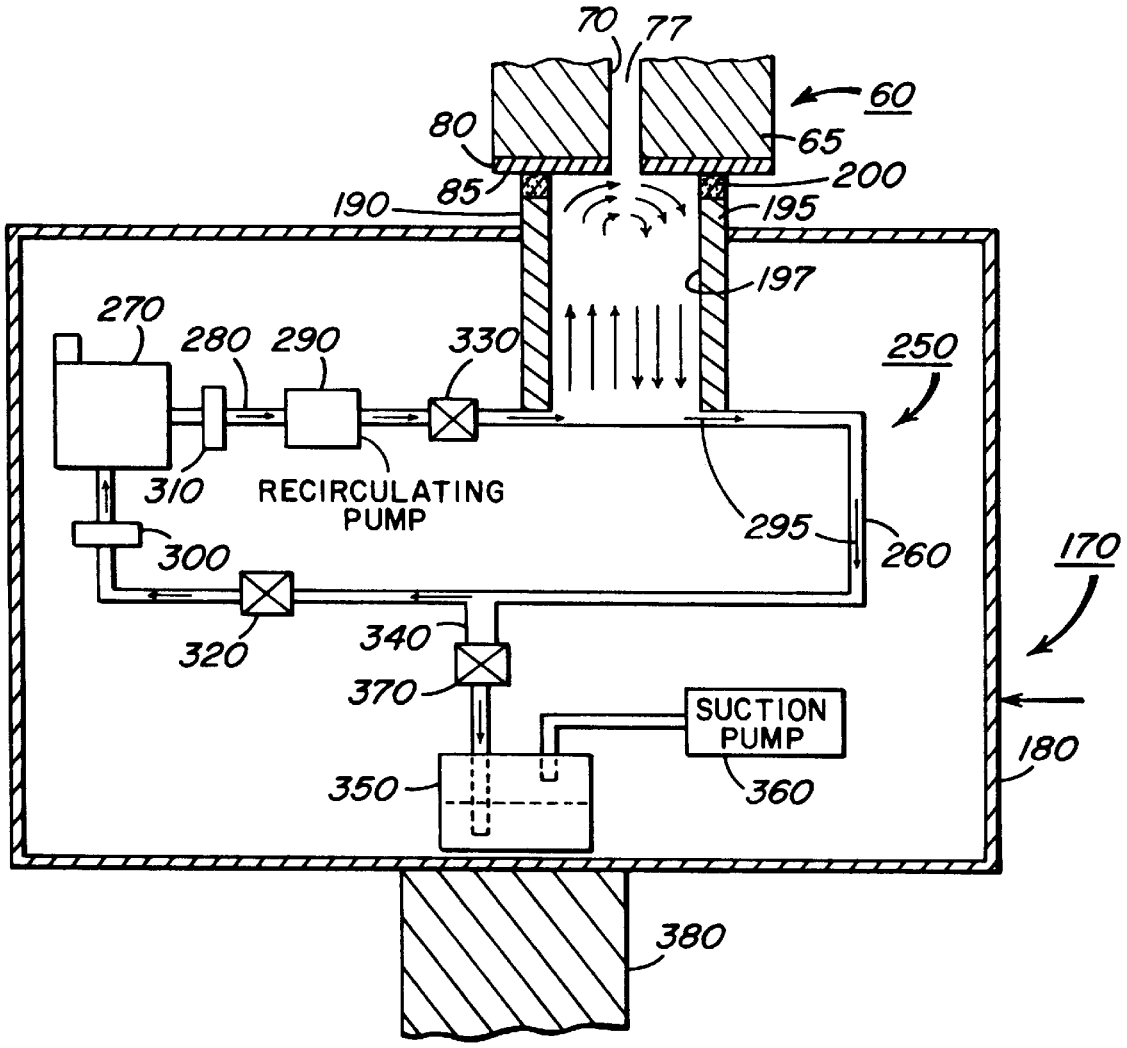
FIG. 12 is a view in vertical section of a fourth embodiment of the invention, wherein the septum is absent for increasing size of the gap to its maximum extent.

Referring to FIG. 12, there is shown a fourth embodiment of the present invention. In this fourth embodiment of the invention, septum 210 is absent and particulate matter 165 is cleaned from surface 85 and/or orifice 90 without need of septum 210. In this case, gap 220 is sized to its maximum extent, due to absence of septum 210, to allow a minimum amount of shear force to act against particulate matter 165. This embodiment of the invention is particularly useful when there is a minimum amount of particulate matter present or when it is desired to exert a minimum amount of shear force against surface 85 and/or orifice 90 to avoid possible damage to surface 85 and/or orifice 90.

Figure 13:
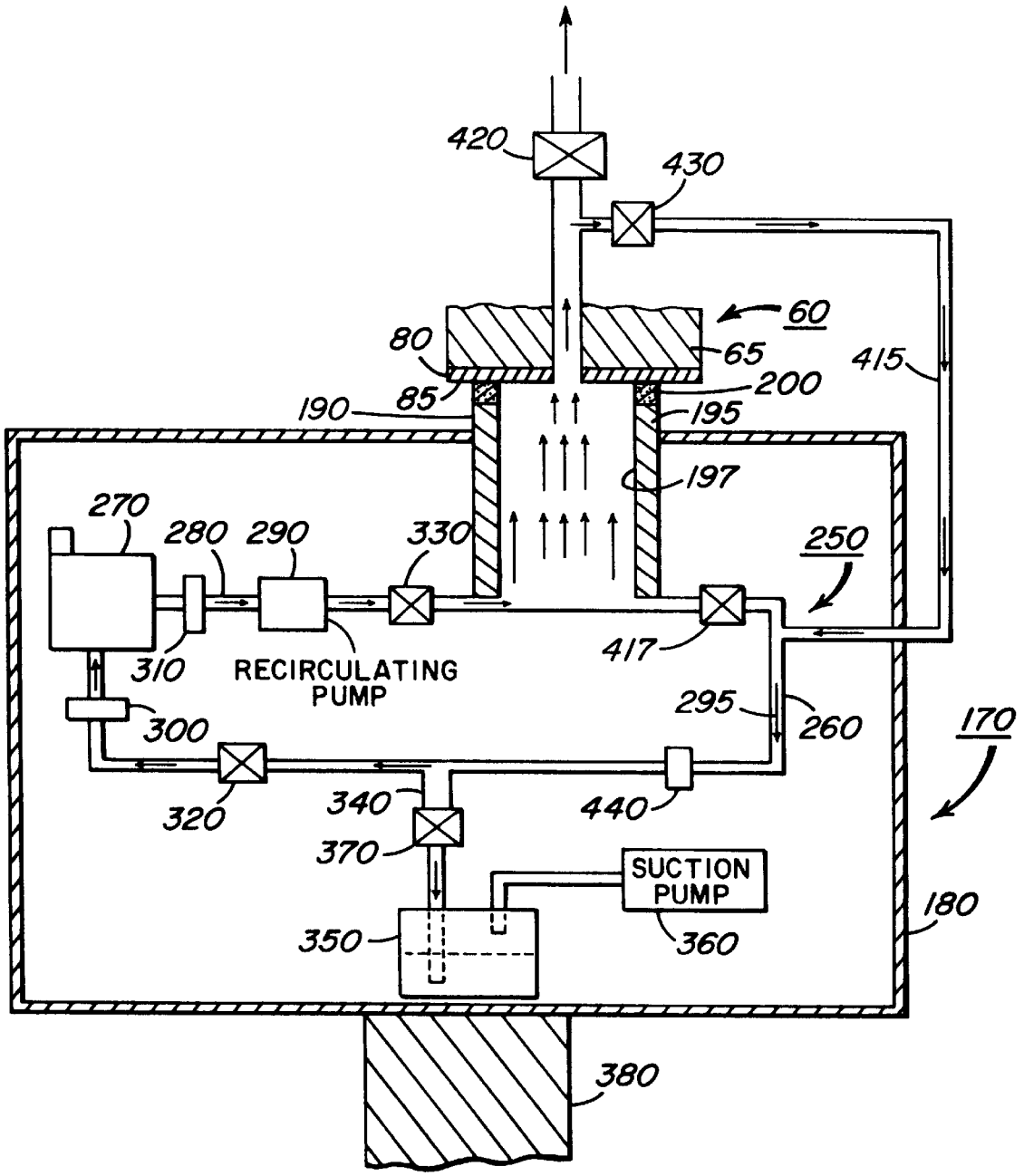
FIG. 13 is a view in vertical section of a fifth embodiment of the invention, wherein the septum is absent and flow of cleaning liquid is directed into the channel through the orifice.

Referring to FIG. 13, there is shown a fifth embodiment of the present invention. In this fifth embodiment of the invention, septum 210 is absent and particulate matter 165 is cleaned from side walls 79*a*/*b* of channel 70 without need of septum 210. In this case, piping circuit 250 comprises a flexible fourth piping segment 415 (e.g., a flexible hose) interconnecting channel 70 and first piping segment 260. Fourth piping segment 415 is sufficiently long and flexible to allow unimpeded motion of print head 60I during printing. According to this fifth embodiment of the invention, piping circuit 250 includes a fourth valve 417 disposed in first piping segment 260 and a fifth valve 420 is in communication with channel 70. In addition, a sixth valve 430 is disposed in fourth piping segment 415 between fifth valve 420 and first piping segment 260. During operation, fourth valve 417, third valve 330 and fifth valve 420 are closed while sixth valve 430 and second valve 330 are opened. Recirculation pump 290 is then operated to pump the cleaning liquid into cavity 197. The cleaning liquid is therefore circulated in the manner shown by the plurality of second arrows 295. The liquid exiting through sixth valve 430 is transported through fourth piping segment 415.

Still referring to FIG. 13, the liquid emerging through sixth valve 430 initially will be contaminated with particulate matter 165. It is desirable to collect this liquid in sump 350 rather than to recirculate the liquid. Therefore, this contaminated liquid is directed to sump 350 by closing second valve 330 and opening third valve 370 while suction pump 360 operates. The liquid will then be free of particulate matter 165 and may be recirculated by closing third valve 370 and opening second valve 330. A detector 440 is disposed in first piping segment 260 to determine when the liquid is clean enough to be recirculated. Information from detector 440 can be processed and used to activate the valves in order to direct exiting liquid either into sump 350 or into recirculation. In this regard, detector 440 may be a spectrophotometric detector. In any event, at the end of the cleaning procedure, suction pump 360 is activated and third valve 370 is opened to suction into sump 350 any trapped liquid remaining between second valve 330 and first valve 320. This process prevents spillage of liquid when cleaning assembly 170 is detached from cover plate 80. Further, this process causes cover plate 80 to be substantially dry, thereby permitting print head 60 to function without interference from cleaning liquid drops being around orifices 90. To resume printing, sixth valve 430 is closed and fifth valve 420 is opened to prime channel 70 with ink. Suction pump 360 is then again activated, and third valve 370 is opened to suction any liquid remaining in cup 190. Alternatively, the cup 190 may be detached and a separate spittoon (not shown) may be brought into alignment with print head 60 to collect drops of ink that are ejected from channel 70 during priming of print head 60.

Figure 14:
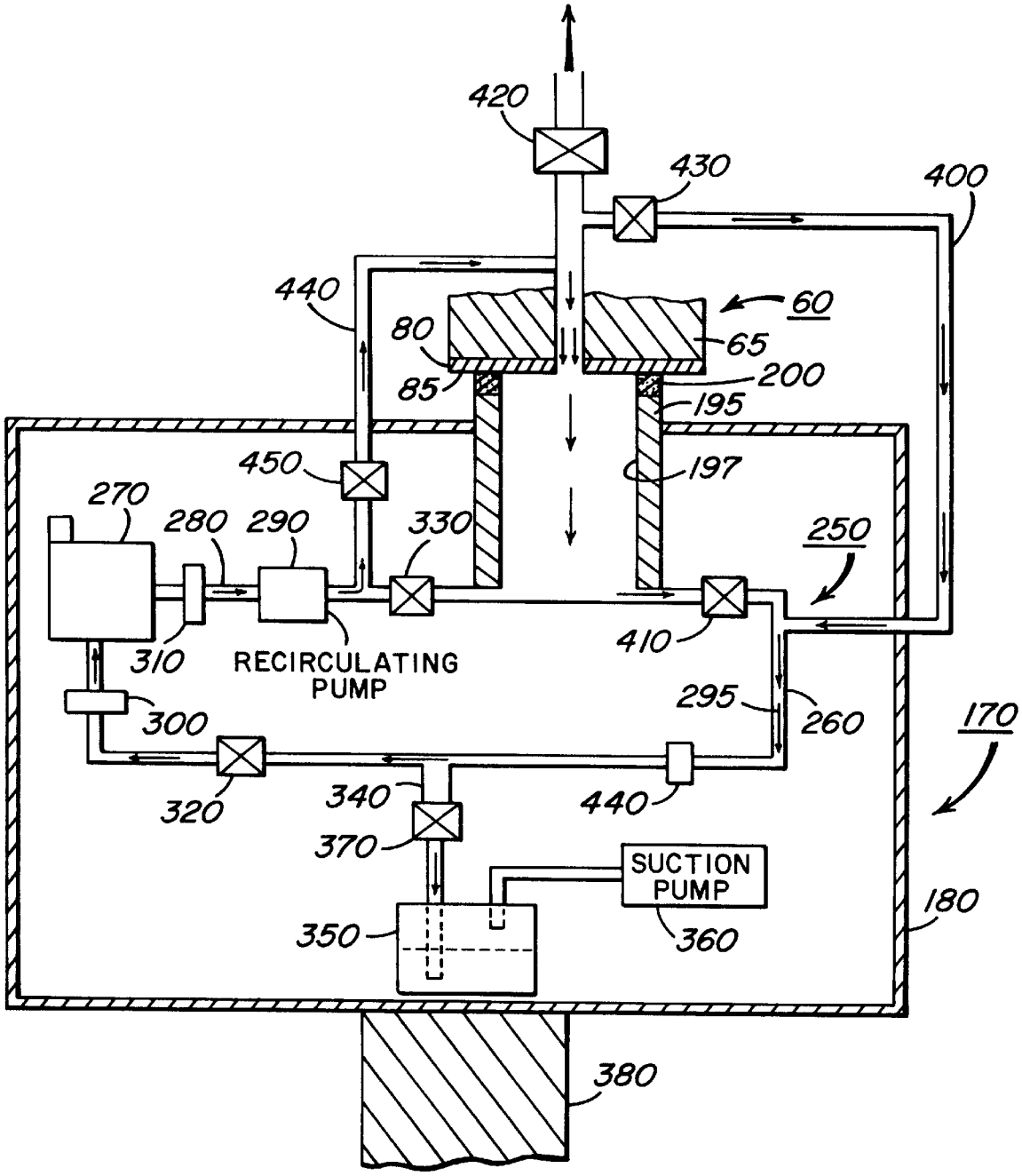
FIG. 14 is a view in vertical section of a sixth embodiment of the invention, wherein the septum is absent and flow of cleaning liquid is directed into the ink channel through a posterior portion of the channel.

Referring to FIG. 14, there is shown an sixth embodiment of the invention, wherein cleaning assembly 170 may further include a fourth piping segment 440. Fourth piping segment 440 has an inlet portion connected to second piping segment 280, which inlet portion is interposed between recirculation pump 290 and second valve 330. The fourth piping segment 440 has an outlet portion connected to channel 70 between a fifth valve 420 and orifice 90. Included in the fourth piping segment 440 is a seventh valve 450. In operation, valves 320, 427 and 410 are open. Recirculation pump 290 pumps cleaning solvent via channel 70 through orifice 90 into cup 190 and in a recirculating pattern through the piping circuitry already described. If desired, valve 320 can be closed and valve 370 opened to deposit contaminated solvent into sump 350. It is understood that air purge valves (not shown) also may be provided to purge the piping circuit of trapped air.

The cleaning liquid may be any suitable liquid solvent composition, such as water, isopropanol, diethylene glycol, diethylene glycol monobutyl ether, octane, acids and bases, surfactant solutions and any combination thereof. Complex liquid compositions may also be used, such as microemulsions, micellar surfactant solutions, vesicles and solid particles dispersed in the liquid.

It may be appreciated from that description hereinabove, that an advantage of the present invention is that cleaning assembly 170 cleans particulate matter 165 from surface 85 and/or orifice 90 without use of brushes or wipers which might otherwise damage surface 85 and/or orifice 90. This is so because septum 210 induces shear stress in the liquid that flows through gap 220 to clean particulate matter 165 from surface 85 and/or orifice 90.

It may be appreciated from the description hereinabove, that another advantage of the present invention is that surface 85 and/or orifice 90 is cleaned of particulate matter 165 without affecting printing speed. This is so because print head 60, which is decelerated as print head 60 approaches second position 115*b*, is accelerated as print head 60 travels back toward receiver 30. More specifically, rate of acceleration of print head 60 back toward receiver 30 is such that the rate of acceleration compensates for rate of deceleration of print head 60 and time that print head 60 dwells at second position 115*b*.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, a heater may be disposed in reservoir 270 to heat the liquid therein for enhancing cleaning of surface 85, channel 70 and/or orifice 90. This is particularly useful when the cleaning liquid is of a type that increases in cleaning effectiveness as temperature of the liquid is increased. As another example, in the case of a multiple color printer having a plurality of print heads corresponding to respective ones of a plurality of colors, one or more dedicated cleaning assemblies per color might be used to avoid cross-contamination of print heads by inks of different colors. As yet another example, a contamination detector may be connected to cleaning assembly 170 for detecting when cleaning is needed. In this regard, such a contamination detector may a pressure transducer in fluid communication with ink in channels 70 for detecting rise in ink back pressure when partially or completely blocked channels 70 attempt to eject ink droplets 105. Such a contamination detector may also be a flow detector in communication with ink in channels 70 to detect low ink flow when partially or completely blocked channels 70 attempt to eject ink droplets 105. Such a contamination detector may also be an optical detector in optical communication with surface 85 and orifices 90 to optically detect presence of particulate matter 165 by means of reflection or emmisivity. Such a contamination detector may also be a device measuring amount of ink released into a spittoon-like container during predetermined periodic purgings of channels 70. In this case, the amount of ink released into the spittoon-like container would be measured by the device and compared against a known amount of ink that should be present in the spittoon-like container if no orifices were blocked by particulate matter 165.

Therefore, what is provided is a self-cleaning printer and method of assembling same, which self-cleaning printer allows cleaning without affecting printing speed.

PARTS LIST

H . . . height of seal
W . . . greater width of fabricated septum
X . . . greater length of fabricated septum
10 . . . printer
20 . . . image
30 . . . receiver
40 . . . platen roller
50 . . . platen roller motor
55 . . . first arrow
60 . . . print head
65 . . . print head body
70 . . . channel
75 . . . channel outlet
77 . . . .ink body
79*a/b* . . . side walls
80 . . . cover plate
85 . . . surface (of cover plate)
90 . . . orifice
100 . . . meniscus
105 . . . ink droplet
107 . . . first axis
110 . . . transport mechanism
115*a/b* first and second position (of print head)
120 . . . guide rail
130 . . . drive belt
140 . . . drive belt motor
150 . . . encoder strip
160 . . . controller
165 . . . particulate matter
167 . . . second axis
170 . . . cleaning assembly
180 . . . housing
190 . . . cup
195 . . . open end (of cup)
197 . . . cavity
200 . . . seal
210 . . . septum
215 . . . end portion (of septum)
220 . . . gap
230 . . . inlet chamber
240 . . . outlet chamber
250 . . . piping circuit
260 . . . first piping segment
270 . . . reservoir
280 . . . second piping segment
290 . . . recirculation pump
295 . . . second arrows
300 . . . first filter
310 . . . second filter
320 . . . first valve
330 . . . second valve
340 . . . third piping segment
350 . . . sump
360 . . . suction pump
370 . . . third valve
380 . . . elevator
390 . . . gas supply
395 . . . gas bubbles
400 . . . piston arrangement
410 . . . piston
415 . . . fourth piping segment
417 . . . fourth valve
420 . . . fifth valve
430 . . . sixth valve
440 . . . fifth piping segment
450 . . . seventh valve

What is claimed is:

1. A self-cleaning printer, comprising:

(a) a print head having a surface thereon;

(b) a structural member disposed opposite the surface for defining a gap therebetween sized to allow a flow of fluid through the gap, said member accelerating the flow of fluid to induce a shearing force in the flow of fluid, whereby the shearing force acts against the surface while the shearing force is induced in the flow of fluid and whereby the surface is cleaned while the shearing force acts against the surface; and (c) a piston arrangement in fluid communication with the gap for generating a pressure wave in the flow of fluid to enhance cleaning of the surface.

2. The self-cleaning printer of claim 1, further comprising a pump in fluid communication with the gap for pumping the fluid through the gap.

3. The self-cleaning printer of claim 1, further comprising a gas supply in fluid communication with the gap for injecting a gas into the gap to form a gas bubble in the flow of fluid for enhancing cleaning of the surface.

4. A self-cleaning printer, comprising:

(a) a print head having a surface having contaminant thereon;

(b) a cleaning assembly disposed relative to the surface for directing a flow of fluid along the surface to clean the contaminant from the surface, said assembly including a septum disposed opposite the surface for defining a gap therebetween sized to allow the flow of fluid through the gap, said septum accelerating the flow of fluid to induce a hydrodynamic shearing force in the flow of fluid, whereby the shearing force acts against the contaminant while the shearing force is induced in the flow of fluid and whereby the contaminant is cleaned from the surface while the shearing force acts against the contaminant; and (c) a piston arrangement in fluid communication with the gap for generating a pressure wave in the flow of fluid to enhance cleaning of the contaminant from the surface.

5. The self-cleaning printer of claim 4, further comprising a pump in fluid communication with the gap for pumping the fluid and contaminant from the gap.

6. The self-cleaning printer of claim 4, further comprising a pressurized gas supply in fluid communication with the gap for injecting a pressurized gas into the gap to form a plurality of gas bubbles in the flow of fluid for enhancing cleaning of the contaminant from the surface.

7. A self-cleaning printer, comprising:

(a) a print head movable from a first position to a second position thereof, said print head having a surface defining an orifice therethrough, the orifice having particulate matter obstructing the orifice;

(b) a cleaning assembly disposed proximate the surface for directing a flow of liquid along the surface and across the orifice to clean the particulate matter from the orifice while said print head is at the second position thereof, said assembly including:

(i) a cup scalingly surrounding the orifice, said cup defining a cavity therein;

(ii) an elongate septum disposed in said cup perpendicularly opposite the orifice for defining a gap between the orifice and said septum, the gap sized to allow the flow of liquid through the gap, said septum dividing the cavity into an inlet chamber and an outlet chamber each in communication with the gap, said septum accelerating the flow of liquid to induce a hydrodynamic shearing force in the flow of liquid, whereby the shearing force acts against the particulate matter while the shearing force is induced in the flow of liquid, whereby the particulate matter is cleaned from the orifice while the shearing force acts against the particulate matter and whereby the particulate matter is entrained in the flow of liquid while the particulate matter is cleaned from the orifice;

(iii) a pump in fluid, communication with the outlet chamber for pumping the liquid and entrained particulate matter from the gap and into the outlet chamber;

(c) a transport mechanism connected to said print head for moving said print head from the first position to the second position thereof;

(d) a controller connected to said transport mechanism, said cleaning assembly and said print head for controlling operation thereof; and (e) a reciprocating piston in fluid communication with the inlet chamber for generating a plurality of pressure waves in the flow of liquid to enhance cleaning of the particulate matter from the orifice.

8. The self-cleaning printer of claim 7, further comprising a pressurized gas supply in fluid communication with the gap for injecting a pressurized gas into the gap to form a multiplicity of gas bubbles in the flow of liquid for enhancing cleaning of the particulate matter from the orifice.

9. The self-cleaning printer of claim 7, further comprising a closed-loop piping circuit in fluid communication with the gap for recycling the flow of liquid through the gap.

10. The self-cleaning printer of claim 9, wherein said piping circuit comprises:

(a) a first piping segment in fluid communication with the inlet chamber; and (b) a second piping segment connected to said first piping segment, said second piping segment in fluid communication with the outlet chamber and connected to said pump, whereby said pump pumps the flow of liquid and entrained particulate matter from the gap, into the outlet chamber, through said second piping segment, through said second piping segment, into the inlet chamber and back into the gap.

11. The self-cleaning printer of claim 10, further comprising:

(a) a first valve connected to said first piping segment and operable to block the flow of liquid through said first piping segment;

(b) a second valve connected to said second piping segment and operable to block the flow of liquid through said second piping segment; and (c) a suction pump interposed between said first valve and said second valve for suctioning the liquid and entrained particulate matter from said first piping segment and said second piping segment while said first valve blocks the first piping segment and while said second valve blocks said second piping segment.

12. The self-cleaning printer of claim 11, further comprising a sump connected to said suction pump for receiving the flow of liquid and particulate matter suctioned by said suction pump.

13. The self-cleaning printer of claim 9, further comprising a filter connected to said piping circuit for filtering the particulate matter from the flow of liquid.

14. The self-cleaning printer of claim 7, further comprising an elevator connected to said cleaning assembly for elevating said cleaning assembly into engagement with the surface of said print head while said print head is in the second position thereof.

15. The self-cleaning printer of claim 14, wherein said elevator is connected to said controller, so that operation of said elevator is controlled by said controller.

16. A self-cleaning printer, comprising:

(a) a print head movable from a first position to a second position thereof, said print head having a surface defining an orifice therethrough, the orifice having particulate matter obstructing the orifice;

(b) a cleaning assembly disposed proximate the surface for directing a flow of liquid along the surface and across the orifice to clean the particulate matter from the orifice while said print head is at the second position thereof, said assembly including:

(i) a cup sealingly surrounding the orifice, said cup defining a cavity therein sized to allow the flow of liquid through the cavity, the flow of liquid being accelerated while the liquid flows through the cavity in order to induce a hydrodynamic shearing force in the flow of liquid, whereby the shearing force acts against the particulate matter while the shearing force is induced in the flow of liquid, whereby the particulate matter is cleaned from the orifice while the shearing force acts against the particulate matter and whereby the particulate matter is entrained in the flow of liquid while the particulate matter is cleaned from the orifice;

(ii) a pump in fluid communication with the cavity for pumping the liquid and entrained particulate matter from the cavity;

(c) a transport mechanism connected to said print head for moving said print head from the first position to the second position thereof;

(d) a controller connected to said transport mechanism, said cleaning assembly and said print head for controlling operation thereof; and (e) a piston arrangement in fluid communication with the gap for generating a pressure wave in the flow of fluid to enhance cleaning of the contaminant from the surface.

17. A method of assembling a self-cleaning printer, comprising the steps of disposing a structural member opposite a surface of a print head for defining a gap therebetween sized to allow a flow of fluid through the gap, the member accelerating the flow of fluid to induce a shearing force in the flow of fluid and disposing a piston arrangement in communication with the gap for generating a pressure wave in the flow of fluid to enhance cleaning of the surface, whereby the shearing force acts against the surface while the shearing force is induced in the flow of fluid and whereby the surface is cleaned while the shearing force acts against the surface.

18. The method of claim 17, further comprising the step of disposing a pump in fluid communication with the gap for pumping the fluid through the gap.

19. The method of claim 17, further comprising the step of disposing a gas supply in fluid communication with the gap for injecting a gas into the gap to form a gas bubble in the flow of fluid for enhancing cleaning of the surface.

20. A method of assembling a self-cleaning printer, comprising the steps of disposing a cleaning assembly relative to a surface of a print head for directing a flow of fluid along the surface to clean a contaminant from the surface, the assembly including a septum disposed opposite the surface for defining a gap therebetween sized to allow the flow of fluid through the gap, the septum accelerating the flow of fluid to induce a hydrodynamic shearing force in the flow of fluid and disposing a piston arrangement in fluid communication with the gap for generating a pressure wave in the flow of fluid to enhance cleaning of the contaminant from the surface, whereby the shearing force acts against the contaminant while the shearing force is induced in the flow of fluid and whereby the contaminant is cleaned from the surface while the shearing force acts against the contaminant.

21. The method of claim 20, further comprising the step of disposing a pump in fluid communication with the gap for pumping the fluid and contaminant from the gap.

22. The method of claim 20, further comprising the step of disposing a pressurized gas supply in fluid communication with the gap for injecting a pressurized gas into the gap to form a plurality of gas bubbles in the flow of fluid for enhancing cleaning of the contaminant from the surface.

23. A method of assembling a self-cleaning printer, comprising the steps of:

(a) providing a print head movable from a first position to a second position thereof, the print head having a surface defining an orifice therethrough, the orifice having particulate matter obstructing the orifice;

(b) disposing a cleaning assembly proximate the surface for directing a flow of liquid along the surface and across the orifice to clean the particulate matter from the orifice while the print head is at the second position thereof, the step of disposing a cleaning assembly including the steps of:

(i) providing a cup for sealingly surrounding the orifice, the cup defining a cavity therein;

(ii) disposing an elongate septum in the cup perpendicularly opposite the orifice for defining a gap between the orifice and the septum, the gap sized to allow the flow of liquid through the gap, the septum dividing the cavity into an inlet chamber and an outlet chamber each in communication with the gap, the septum accelerating the flow of liquid to induce a hydrodynamic shearing force in the flow of liquid, whereby the shearing force acts against the particulate matter while the shearing force is induced in the flow of liquid, whereby the particulate matter is cleaned from the orifice while the shearing force acts against the particulate matter and whereby the particulate matter is entrained in the flow of liquid while the particulate matter is cleaned from the orifice;

(iii) disposing a pump in fluid communication with the outlet chamber for pumping the liquid and entrained particulate matter from the gap and into the outlet chamber;

(c) connecting a transport mechanism to the print head for moving the print head from the first position to the second position thereof;

(d) connecting a controller to the transport mechanism, the cleaning assembly and the print head for controlling operation thereof; and (e) disposing a reciprocating piston in fluid communication with the inlet chamber for generating a plurality of pressure waves in the flow of liquid to enhance cleaning of the particulate matter from the orifice.

24. The method of claim 23, further comprising the step of disposing a pressurized gas supply in fluid communication with the gap for injecting a pressurized gas into the gap to form a multiplicity of gas bubbles in the flow of liquid for enhancing cleaning of the particulate matter from the orifice.

25. The method of claim 23, further comprising the step of disposing a closed-loop piping circuit in fluid communication with the gap for recycling the flow of liquid through the gap.

26. The method of claim 25, wherein the step of disposing the piping circuit comprises the steps of:

(a) disposing a first piping segment in fluid communication with the inlet chamber; and (b) connecting a second piping segment to the first piping segment, the second piping segment in fluid communication with the outlet chamber and connected to the pump, whereby the pump pumps the flow of liquid and entrained particulate matter from the gap, into the outlet chamber, through the second piping segment, through the second piping segment, into the inlet chamber and back into the gap.

27. The method of claim 26, further comprising the steps of:

(a) connecting a first valve to the first piping segment and operable to block the flow of liquid through the first piping segment;

(b) connecting a second valve to the second piping segment and operable to block the flow of liquid through the second piping segment; and (c) interposing a suction pump between the first valve and the second valve for suctioning the liquid and entrained particulate matter from the first piping segment and the second piping segment while the first valve blocks the first piping segment and while the second valve blocks the second piping segment.

28. The method of claim 27, further comprising the step of connecting a sump to the suction pump for receiving the flow of liquid and particulate matter suctioned by the suction pump.

29. The method of claim 25, further comprising the step of connecting a filter to the piping circuit for filtering the particulate matter from the flow of liquid.

30. The method of claim 23, further comprising the step of connecting an elevator to the cleaning assembly for elevating the cleaning assembly into engagement with the surface of the print head while the print head is in the second position thereof.

31. The method of claim 30, wherein the step of connecting an elevator comprises the step of connecting an elevator to the controller, so that operation of the elevator is controlled by the controller.

32. A method of assembling a self-cleaning printer, comprising the steps of:

(a) providing a print head movable from a first position to a second position thereof, the print head having a surface defining an orifice therethrough, the orifice having particulate matter obstructing the orifice;

(b) disposing a cleaning assembly proximate the surface for directing a flow of liquid along the surface and across the orifice to clean the particulate matter from the orifice while the print head is at the second position thereof, the step of disposing a cleaning assembly including the steps of:

(i) providing a cup for sealingly surrounding the orifice, the cup defining a cavity therein sized to allow the flow of liquid through the cavity, the flow of liquid being accelerated while the liquid flows through the cavity in order to induce a hydrodynamic shearing force in the flow of liquid, whereby the shearing force acts against the particulate matter while the shearing force is induced in the flow of liquid, whereby the particulate matter is cleaned from the orifice while the shearing force acts against the particulate matter and whereby the particulate matter is entrained in the flow of liquid while the particulate matter is cleaned from the orifice;

(ii) disposing a pump in fluid communication with the cavity for pumping the liquid and entrained particulate matter from the cavity;

(c) connecting a transport mechanism to the print head for moving the print head from the first position to the second position thereof;

(d) connecting a controller to the transport mechanism, the cleaning assembly and the print head for controlling operation thereof; and (e) disposing a piston arrangement in fluid communication with the gap for generating a pressure wave in the flow of fluid to enhance cleaning of the contaminant from the surface.

* * * * *